US006053184A

United States Patent [19]

DeVone

[11] Patent Number: 6,053,184

[45] Date of Patent: Apr. 25, 2000

[54] APPLICATOR FOR MEDICINAL THERAPEUTIC, PHARMACEUTICAL, AND COSMETIC PREPARATIONS

[75] Inventor: Adam R. DeVone, Laguna Niguel, Calif.

[73] Assignee: Handsfree Applicators, Inc., Irvine, Calif.

[21] Appl. No.: 09/344,773

[22] Filed: Jun. 28, 1999

Related U.S. Application Data

[63] Continuation of application No. 09/120,908, Jul. 22, 1998, abandoned, which is a continuation-in-part of application No. 08/917,037, Aug. 22, 1997, abandoned, which is a continuation-in-part of application No. 08/861,948, May 22, 1997, Pat. No. 5,871,020.

[51] Int. Cl.[7] ..... A45D 40/26

[52] U.S. Cl. ..... 132/317

[58] Field of Search ..... 132/317, 320, 132/74.5, 73; 401/202, 205, 262, 139, 266; 215/355, 364, 320; 220/256, 229, 367.1, 369, 373

[56] References Cited

U.S. PATENT DOCUMENTS

| | | | |
|---|---|---|---|
| 611,485 | 9/1898 | Hosfeld | 401/266 |
| 1,581,563 | 4/1926 | Brown . | |
| 1,949,976 | 3/1934 | Runnels . | |
| 3,054,133 | 9/1962 | Hublard et al. | 401/266 |
| 3,072,953 | 1/1963 | Bunke | 401/266 |
| 3,135,007 | 6/1964 | Howell . | |
| 3,756,732 | 9/1973 | Stöffler . | |
| 4,446,965 | 5/1984 | Montiel . | |
| 4,964,372 | 10/1990 | Zeeni et al. . | |
| 5,054,503 | 10/1991 | Keller . | |
| 5,649,859 | 7/1997 | Shiga . | |
| 5,988,923 | 11/1999 | Arai | 401/266 |

FOREIGN PATENT DOCUMENTS

| | | | |
|---|---|---|---|
| 551938 | 11/1956 | Belgium . | |
| 1814434 | 12/1968 | Germany . | |
| 3938347 | 11/1989 | Germany . | |
| 602402 | 2/1960 | Italy . | |
| 725829 | 11/1966 | Italy | 401/262 |
| 6805429 | 10/1969 | Netherlands . | |
| 742615 | 12/1955 | United Kingdom . | |
| 857968 | 1/1961 | United Kingdom . | |

*Primary Examiner*—Jeffrey A. Smith
*Assistant Examiner*—Eduardo C. Robert
*Attorney, Agent, or Firm*—William G. Lane, Esq.

[57] ABSTRACT

An improved applicator for medicinal, therapeutic, pharmaceutical, and/or cosmetic preparations comprising an applicator head having a foam applicator head, a flexible tubular reservoir for storing the preparation, and a cap to seal off the applicator end of the applicator head. The foam having one or more slits which form communication passageways between the reservoir and the applicator head and which are compressed by the cap to prevent migration of air from the exterior into the reservoir and passage of preparation from the reservoir to the applicator head when the cap is seated on the applicator head.

33 Claims, 8 Drawing Sheets

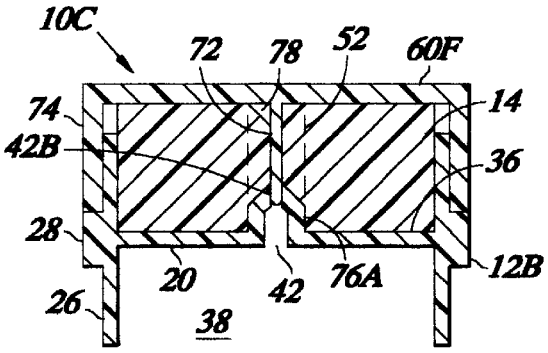
Fig. 27
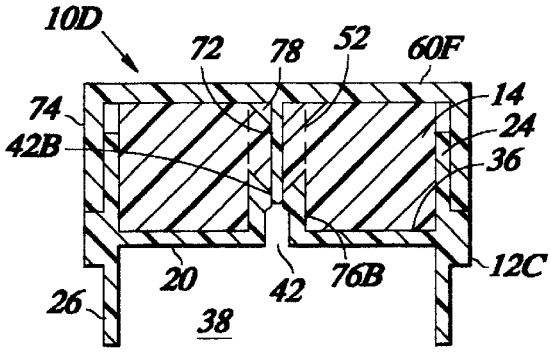
Fig. 30
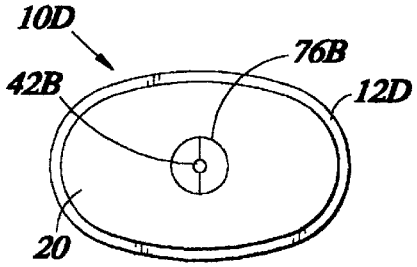
Fig. 28
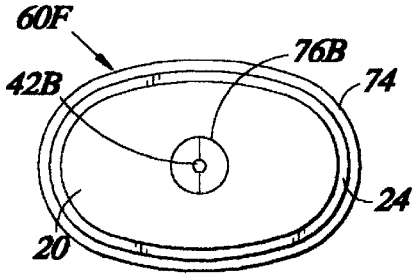
Fig. 31
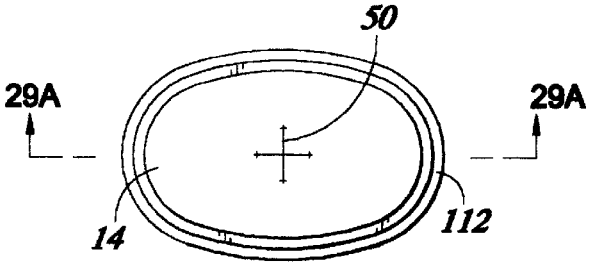
Fig. 29
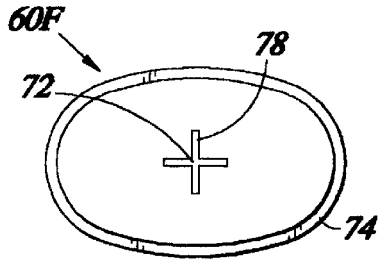
Fig. 32
Fig. 29A
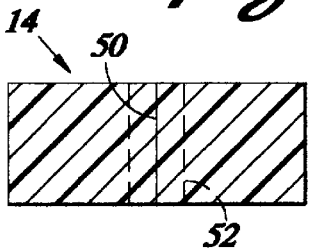

APPLICATOR FOR MEDICINAL THERAPEUTIC, PHARMACEUTICAL, AND COSMETIC PREPARATIONS

This application is a continuation of U.S. patent application Ser. No. 09/120,908, filed Jul. 22, 1998, now abandoned, which is a continuation-in-part of U.S. pending application Ser. No. 08/917,037 filed Aug. 22, 1997, now abandoned, which is a continuation-in-part of U.S. pending application Ser. No. 08/861,948 filed May 22, 1997, now U.S. Pat. No. 5,871,020 for Improved Applicator for Medicinal, Therapeutic, Pharmaceutical, and Cosmetic Preparations.

SCOPE OF THE INVENTION

The present invention is directed to an applicator for applying medicinal, pharmaceutical, therapeutic and cosmetic preparations and compositions to the skin.

BACKGROUND OF THE INVENTION

The application of many medicinal, pharmaceutical, therapeutic, and cosmetic preparations to the skin can be unpleasant, awkward, or messy because of the constituents in the preparations and compositions (collectively "preparations" herein). In an attempt to overcome this problem with respect to suntan lotion, Solar Gear, Inc. of Newport Beach, Calif., developed an applicator comprising a plastic tube sealed at one end with its other end attached to a shoulder element. The tube functions as a reservoir for the suntan lotion. Opposite the tube end of the shoulder element, the shoulder element has a foam head for applying the suntan lotion to the skin. The shoulder has an internal transverse wall separating the foam applicator head from the reservoir. A hollow tube extends upwardly from the transverse wall close to the top of the foam applicator head. The tube is in fluid communication with the reservoir and top of the applicator head. A cap fits over the top section of the shoulder. Within the cap, extending downwardly from the center is a shaft. When the cap is placed on the shoulder element, the shaft enters the hollow tube to seal the tube and minimize leakage of the preparation through the tube.

Although the applicator has been successful, it has not proven to be a foolproof sealed system. When pressure is applied to the reservoir, which is a flexible plastic tube, the preparation material, suntan lotion, is forced up in the tube into the space between the shaft and the tube to pool on the top surface of the applicator head. When the cap is removed, the preparation frequently drips at the head and frequently permits excess suntan lotion to spill on clothing or the bathing suit. Suntan lotion can stain fabric.

A second shortcoming of the applicator is the fact that when the cap is removed, the tube is opened, permitting air to enter into the reservoir. The air is an oxidant source for the preparation and can shorten the shelf life and the sunscreening properties of the suntan lotion.

It is an object of the present invention to provide an improved applicator head having a foam application head separated from the reservoir with means for transporting preparation from the reservoir to the applicator head for application to the skin. It is a further object of the present invention to provide a valve system for preventing the flow of the preparation from the reservoir to the applicator head when the applicator is attached.

It is still a further object of the present invention to provide an improved applicator for preparations having a valve system which will prevent the entrance of air into the reservoir when the applicator cap is removed and/or when the preparation from the reservoir is transported to the applicator head.

SUMMARY OF THE INVENTION

The present invention is directed to an improved applicator head comprising a hollow applicator head shell and foam applicator head. The shell has a central cavity, a perimeter wall surrounding the central cavity, an open applicator end, an opposite open reservoir end communicating with the central cavity, and a transverse wall within the shell separating the central cavity into an applicator chamber opening into the open application end and a reservoir chamber opening into the open reservoir end. The transverse wall has at least one opening between the application chamber and the reservoir chamber. The foam applicator pad has an applicator surface, an applicator portion, an opposite base surface, and a base portion. The applicator portion is positioned within the applicator chamber with the applicator surface extending beyond the open application end of the shell. At least a portion of the base surface of the foam applicator head is affixed to the transverse wall to secure the head thereon. The foam applicator pad has at least one slit extending from the applicator surface to the base surface; at least a portion of each slit at the base surface positioned on an opening in the transverse wall to permit the passage of preparation from the reservoir chamber to the applicator surface through the slits. The foam applicator head is secured to the transverse wall by an adhesive or heat weld.

Another embodiment of the present invention is directed to the combination of the improved application head with an improved applicator head. The improved applicator head cap has a perimeter wall, a top transverse wall, a closed top end, and an open bottom end, the top transverse wall sealing off the top end in combination with the perimeter wall. The open end is adapted to receive the applicator end of the shell in a female to male relationship. The cap has means to compress the applicator portion of the foam applicator head to compress the same and to compress the slits and to seal the slits to prevent passage of preparation from the reservoir chamber to the applicator surface and the passage of air into the reservoir chamber.

In one embodiment of the invention, the foam applicator pad has a single longitudinal slit. In another embodiment of the present invention, the foam applicator pad has two or more slits which centrally intersect each other, centering each slit to form a cross, star or the like patterns. In a preferred embodiment of the present invention, the foam applicator head has two longitudinal slits which centrally cross each other to form a cross or an X.

In one embodiment of the present invention, the longitudinal length of each slit remains constant from the applicator surface through the foam applicator head to the base surface of the foam. In another embodiment of the present invention, the longitudinal length of each slit from the applicator surface through the applicator head to the base surface decreases. The length can decrease to the size of the opening in the transverse wall of the applicator head shell.

In one embodiment of the present invention, the transverse wall has one opening and a portion of at least each slit at the base surface is positioned at the opening. In another embodiment of the present invention, the transverse wall has a plurality of openings and at least a portion of each slit is positioned over at least one of such openings. In another embodiment of the present invention, the transverse wall has a plurality of openings and one or more slits, and at least a portion of each slit at the base surface is positioned at two or more openings.

In another embodiment of the present invention, the transverse wall has a hollow shaft extending upwardly from the transverse wall to an elevation below the applicator surface of the foam applicator head, the shaft being hollow and adapted to receive a mating shaft or male-to-female mating relationship mounted in the cap for the improved applicator head to seal the hollow shaft. The slits in combination with the hollow shaft valve and mating shaft act as a stop valve to prevent the passage of air and preparation through the hollow shaft when the cap is attached to the applicator head.

In another embodiment of the present invention, the improved applicator for medicinal, pharmaceutical, therapeutic and cosmetic preparations comprises a hollow applicator head with a shell having a central cavity, a perimeter wall surrounding the central cavity, an open applicator end, and an opposite open reservoir end and a transverse wall within the shell separating the central cavity into an applicator chamber communicating with the open applicator end and the reservoir chamber communicating with the open reservoir end, said transverse wall having at least one opening between the applicator chamber and the reservoir chamber. The applicator has a foam applicator head having an applicator surface and an opposite base surface, an applicator portion and a base portion, the base portion of the foam applicator head positioned in the applicator chamber with the applicator surface extending beyond the open applicator end, at least a portion of the base surface affixed to the transverse wall to secure the foam applicator head in the applicator chamber. The applicator head has at least one slit extending from the applicator surface through the foam to the base surface, at least a portion of each slit in the base surface positioned over one of said openings in the transverse wall. The applicator has an applicator head cap with a perimeter wall, a top transverse wall, a closed top end and an open bottom end, the top transverse wall together with the outer perimeter wall sealing off the top end of the cap, the open bottom end of the cap adapted to receive and seat on the application end of the shell of the improved applicator head, the cap having means to compress the applicator portion of the foam applicator head to compress the walls of the slits together and seal the slits. The applicator has a flexible tubular reservoir member is provided for holding medicinal, pharmaceutical, therapeutic, and/or cosmetic preparations and compositions, the remote end of the tubular member being sealed off, the near end of the tubular member adapted to receive the open reservoir end of the applicator head and to be secured thereto in a sealed relationship.

BRIEF DESCRIPTION OF THE DRAWINGS

FIG. 27 is a side cross-sectional view of another embodiment of the improved applicator head of the present invention;

FIG. 28 is a top cross-sectional view taken along lines 28—28 of FIG. 33;

FIG. 29 is a top view of the applicator head of FIG. 33;

FIG. 29A is a side cross-sectional view of the foam applicator pad taken along lines 29A—29A of FIG. 29;

FIG. 30 is a side cross-sectional view of another embodiment of the improved applicator head of the present invention;

FIG. 31 is a top cross-sectional view taken along lines 31—31 of FIG. 30;

FIG. 32 is a bottom view of the cap of FIG. 27;

DETAILED DESCRIPTION OF THE INVENTION

Figure 1:
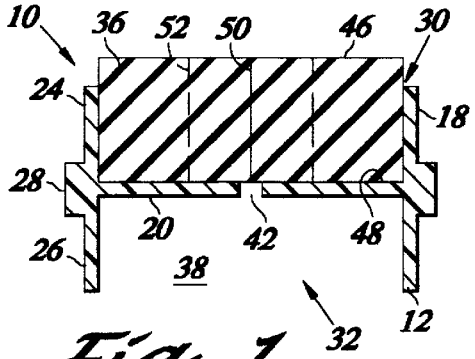
FIG. 1 is a side cross-sectional view of the improved applicator head of the present invention.
Figure 3:
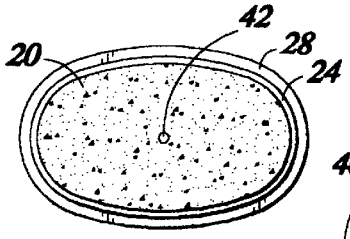
FIG. 3 is a top view of the shell of the improved applicator head of FIG. 1.
Figure 6:
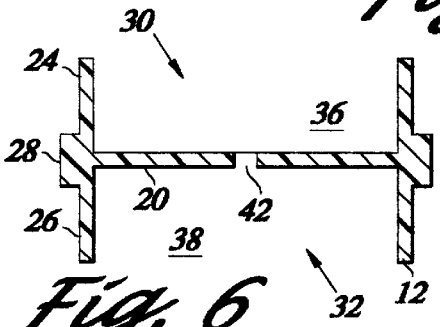
FIG. 6 is a side cross-sectional view of the applicator head shell of FIGS. 1–5.

Referring to FIG. 1, the improved applicator head 10 of the present invention comprises a shell 12 with a foam applicator head 14. Shell 12 has a perimeter wall 18 and a transverse wall 20 inside the shell extending from the inner sides of the perimeter wall completely across the shell (see FIG. 3). The perimeter wall has an upper wall portion 24, a lower wall portion 26, and a shoulder 28. A flexible polymeric tubular reservoir 100 (see FIG. 23) is sealed to the outer side of the lower wall portion 26. The upper wall portion 24 is adapted to receive a cap 60 to seal off the applicator head (see FIGS. 15-20 and 23). The shell has an open applicator end 30 and an opposite open reservoir end 32. The transverse wall 20 divides the inner space of the shell into an application chamber 36 and a reservoir chamber 38 (see FIG. 6). The transverse wall has an opening 42 in fluid communication with the application chamber and reservoir chamber.

The foam application head or pad 14 is positioned within the application chamber 36. The upper or applicator portion 44*a* of the foam application head 14 extends beyond the open applicator end 30 of the shell. The foam application head has an application surface 46 and a base surface 48. The lower or base portion 44*b* of the foam application head is located in the open application chamber 36. Preferably at least a portion of the base surface 48 is secured to the transverse wall to the limit line 52, which will be described below, by adhesive, heat weld, cement or two-sided adhesive tape or film.

Figure 4:
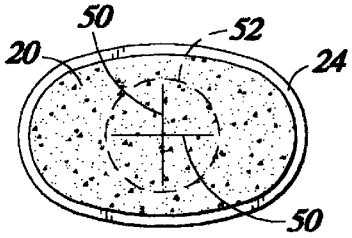
FIG. 4 is a top view of the foam applicator head of FIG. 1.

The foam application head has two longitudinal slits 50 cut through the foam application head from the application surface down to the base surface. The slits are cuts, not grooves, through the foam. They are not channels through the foam when the foam is in a resting state, as shown in FIGS. 1 and 4. In the resting state, the walls of the slit are closed together. The foam, because of its compressive property, keeps the walls of the slit 50 together preventing medicinal, pharmaceutical, therapeutic, or cosmetic preparation in the reservoir chamber 38 from seeping through opening 42 to the applicator surface 46. Similarly, the compressive force of the foam keeps the walls of each slit 50 together to prevent air from diffusing from the exterior into the reservoir chamber 38 through the slits and through the opening 42.

Figure 2:
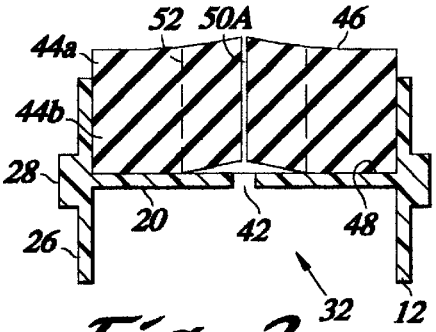
FIG. 2 is a side cross-sectional view similar to that of FIG. 1 showing compression of the foam applicator head during passage of preparation.
Figure 5:
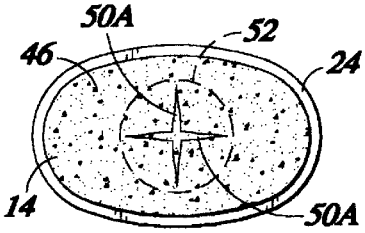
FIG. 5 is a top view of the foam applicator head of FIG. 2.
Figure 23:
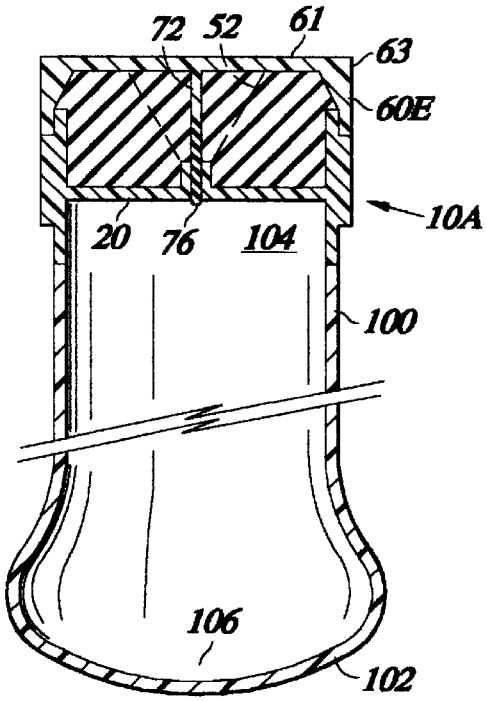
FIG. 23 is a side cross-sectional view of the improved applicator of the present invention.

As shown in FIG. 23, the reservoir 100 is preferably a flexible polymeric tube 101 or container having a sealed bottom end 102. The flexible reservoir is preferably made from tubing having an open near end 104 which is secured to the lower wall portion 26 of the shell 12 and a far open end 106 which is closed off by sealing the opposite walls of the tubing together either with cement or heat treatment to form the sealed bottom end 102. When the flexible reservoir 100 is squeezed or compressed, preparation in the reservoir is forced through opening 42 into the slits 50 which forces the slits walls apart compressing the foam, as shown in FIG. 2 and FIG. 5, to permit the preparation to move from the reservoir chamber to the applicator surface 46 between the walls of the slits which forms a passageway when the preparation is forced through the opening 42. The foam in the vicinity of the slits must have the ability to move and be compressed to separate the walls of each slit, and accordingly, the base surface 48 of the foam applicator head around the opening and optionally to the ends of the slits, the limit line 52, is not secured or affixed to the transverse wall. This permits the foam to move upwardly and the slit walls to separate, as shown in FIG. 2, to permit the foam between the slits to be compressed to allow the space or channel between the split walls to form to permit the passage of preparation from the reservoir to the applicator surface.

Figure 7:
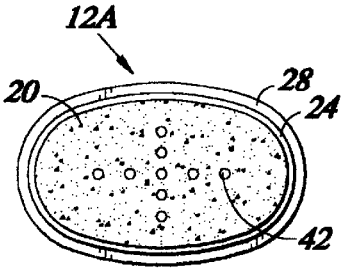
FIG. 7 is a top view of the shell of another embodiment of the present invention.

Referring to FIG. 7, in an alternative embodiment, the shell 12A has a plurality of openings 42 rather than a single opening as shown in FIGS. 1–3 and 4. The slits 50 in the foam applicator head would be positioned over the openings 42 in shell 12A. In all other respects, shell 12A is identical to shell 12.

Figure 8:
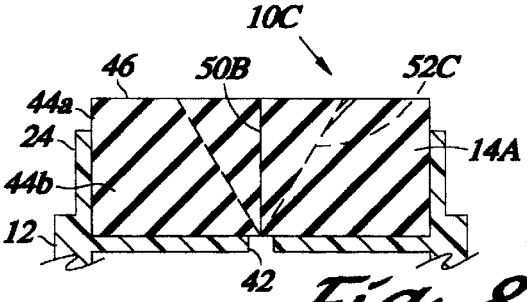
FIG. 8 is a side cross-sectional view of another embodiment of the foam applicator head of the present invention.
Figure 9:
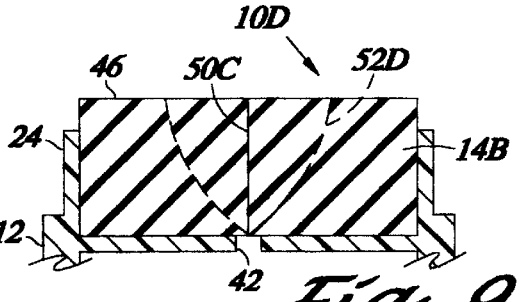
FIG. 9 is a side cross-sectional view of another embodiment of the foam applicator head of the present invention.
Figure 10:
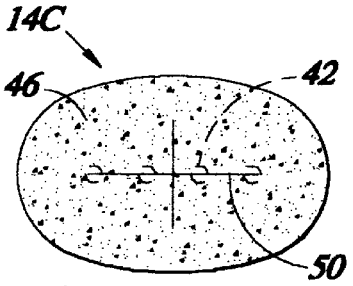
FIG. 10 is a top view of another embodiment of the foam applicator head of the present invention.
Figure 11:
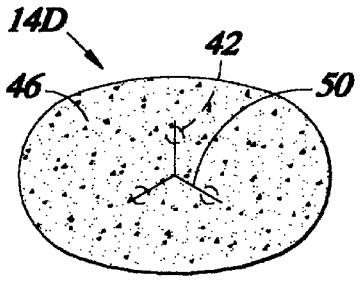
FIG. 11 is a top view of another embodiment of the foam applicator head of the present invention.
Figure 12:
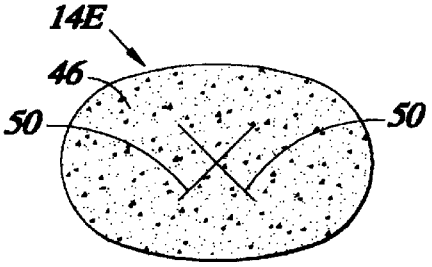
FIG. 12 is a top view of another embodiment of the foam applicator head of the present invention.
Figure 13:
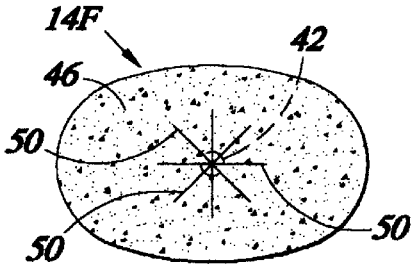
FIG. 13 is a top view of another embodiment of the foam applicator head of the present invention.
Figure 14:
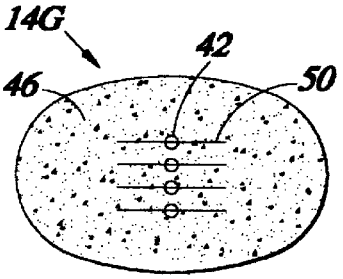
FIG. 14 is a top view of another embodiment of the foam applicator head of the present invention.

Referring to FIGS. 8 and 9, the foam applicator heads 14A and 14B, respectively, have modified slits. These heads have two longitudinal slits which are positioned perpendicular to each other to form a cross in the same manner as the head 14 as shown in FIG. 4. However, the slits in FIGS. 1–5 have longitudinal lengths that are unchanging the entire depth of the foam applicator head from the applicator surface 46 to the base surface 48. In contrast, the slits 50B and 50C in FIGS. 8 and 9 have longitudinal lengths which decrease in length from the applicator surface to the base surface of the head as shown by limit lines 52C and 52D. The slits have sufficient longitudinal length at the opening 42 to bridge the opening and permit the foam over the opening to be compressed to open the slits to permit the passage of preparation from the reservoir into the space between the walls of the slit as described above.

Referring to FIGS. 10–14, the foam applicator heads 14C through 14G have different slit arrangements or patterns when viewed from the top. The foam applicator head 14C has a single longitudinal slit 50 which can be positioned over a single opening (not shown) or a series of openings along a longitudinal line (shown in phantom). Foam applicator head 14D has three longitudinal slits 50 which meet at a common intersection to form a tri-star. Each slit can be positioned over separate openings (shown in phantom), or the tri-star can be centered over a single opening (not shown). Foam applicator head 14E has two longitudinal slits positioned perpendicular to each other and centered upon each other to form an X. This is similar to the configuration shown in FIG. 4 with the slit being rotated 45°. Foam applicator head 14F has four longitudinal slits 50; each slit intersecting the other slits at a common central point. Each slit can be positioned along its own opening (not shown) or all the slits can be positioned over a single opening at the central intersection (shown in phantom). Foam applicator head 14G has four parallel slits 50, each slit being positioned over a separate opening 42 (shown in phantom).

Referring to FIGS. 15–19, the improved applicator head is sealed off with a cap 60–60D to prevent preparation from seeping up from the reservoir to the applicator surface and air from diffusing down into the reservoir. Preparation on the applicator surface can soil clothing and the like. The caps also protects the foam applicator head from dirt.

Cap 60 has a beveled inner wall 61 which compresses the foam of the foam applicator head 14 laterally when the cap is placed on the improved applicator head. The lateral compression of the foam laterally compresses the walls of the slits together in the applicator portion to seal off any slit passageway between the reservoir chamber and the applicator surface 46.

Cap 60A has a central step 62 which extends downwardly from the inner side of the top transverse wall to the interior of the cap which compresses the foam of the foam applicator head 14 longitudinally downward towards the transverse wall. This compression of the foam further compresses the walls of the slits together, further sealing off the slits as a passageway for preparation from the reservoir when the cap is seated on the applicator head.

Cap 60B has an annular bead 64 located on its inner side of the top transverse wall to which forms a ring seal with the applicator surface 46. When the cap is seated on the applicator head, the annular bead compresses the applicator surface 46, compressing the foam to form a seal which prevents the passage of preparation from the slits between the inner side of the cap and the applicator surface 46.

Cap 60C has an angular dome 66 on the inner side of the top transverse wall 70 of the cap which compresses the applicator surface 46 longitudinally downward when the cap is seated on the applicator head, compressing the foam in the head 14, which compresses the walls of the slits together to form a seal to prevent the passage of air into the reservoir and the passage of preparation from the reservoir to the applicator surface as described above.

Cap 60D has a curved dome 68 on the inner side of the top transverse wall 70 of the caps and functions in the same manner as the angular dome 66 of cap 60C described above.

The limit line 52 shown in FIGS. 1, 2, 4, 5, 8, 9, and 15–19 shows the transverse or longitudinal length of the slit with respect to the foam applicator head.

Figure 15:
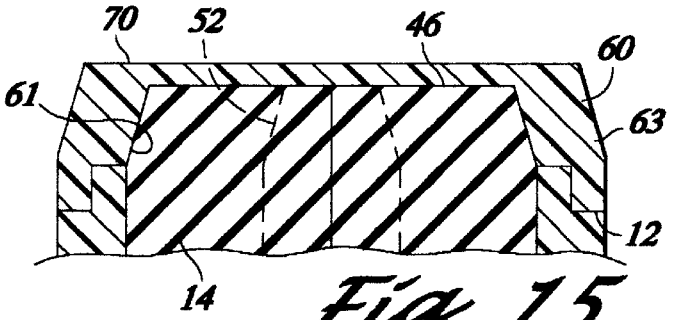
FIG. 15 is a partial side cross-sectional view of an improve d applicator head closed with an improved cap of the present invention.
Figure 16:
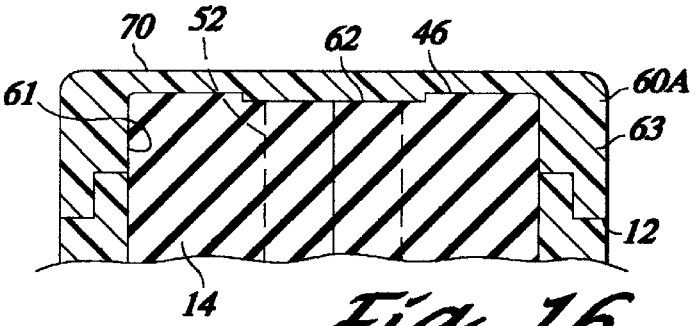
FIG. 16 is a partial side cross-sectional view of an improved applicator head closed with an improved cap of the present invention.
Figure 17:
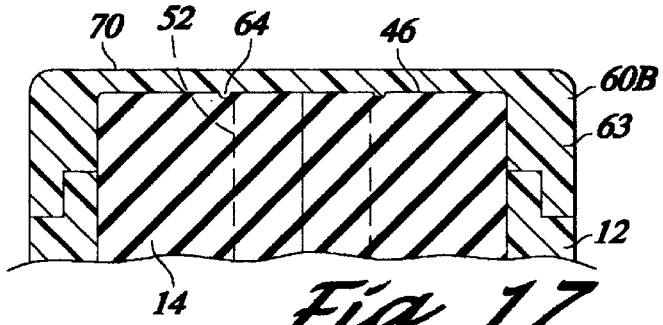
FIG. 17 is a partial side cross-sectional view of an improved applicator head closed with an improved cap of the present invention.
Figure 18:
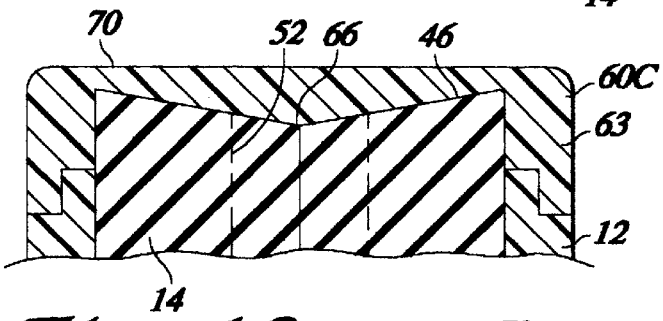
FIG. 18 is a partial side cross-sectional view of an improved applicator head closed with an improved cap of the present invention.
Figure 19:
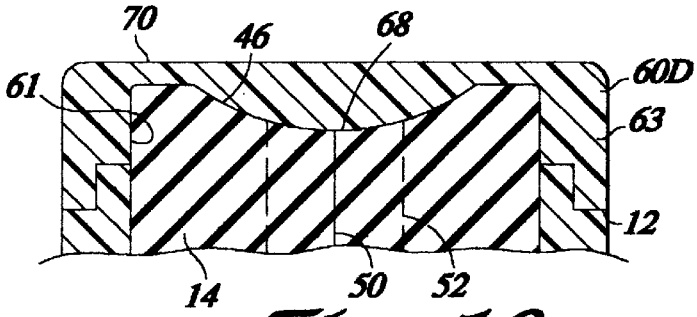
FIG. 19 is a partial side cross-sectional view of an improved applicator head closed with an improved cap of the present invention.
Figure 20:
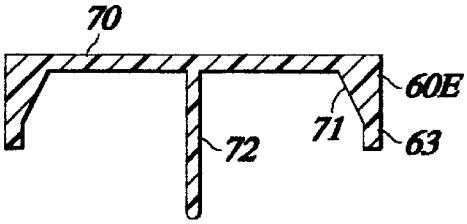
FIG. 20 is a side cross-sectional view of an improved cap for the applicator head of the present invention.
Figure 21:
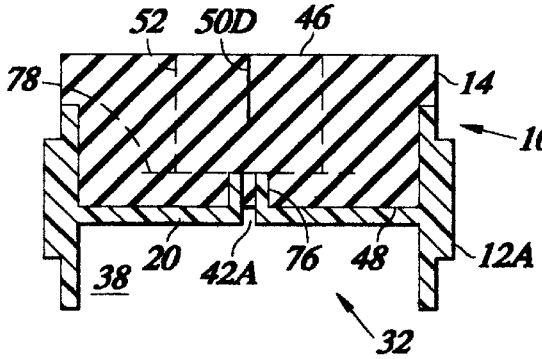
FIG. 21 is a side cross-sectional view of another embodiment of the improved applicator head of the present invention.

Referring to FIGS. 20, 21, and 23, the cap 60E has a transverse top wall 70, a perimeter side wall 63, an inner bevel wall 71 which compresses the foam of the foam applicator head in a manner similar to that shown by cap 60 in FIG. 15. Extending down from the center of the transverse top wall from the inner side is a shaft 72. This cap fits on applicator head 10A which is identical to applicator 10 except for the hollow nozzle 76 through which the opening 42 extends and the modification of the slits 50D in the foam applicator head 14H wherein the longitudinal slits 50D only extend through the foam from the application 46 down to the elevation 78 of the nozzle 76, not to the base surface. However, in other embodiments the slits can extend down to the base surface.

As shown in FIG. 23, when the cap is placed on the applicator head, the shaft 72 penetrates the foam applicator head 14H through slits 50D into the opening 42 of nozzle 76. The mating of shaft 72 with nozzle 76 secures the cap to the applicator head and functions as a valve means for minimizing the passage of preparation from the reservoir through the opening 42A and the slits 50D onto the applicator surface 46 when the cap is seated on the applicator head. The shaft 72 also helps compress the foam of the foam applicator head which, in turn, forces the walls of the slits together to form a tighter seal of the slits to prevent the passage of preparation out of opening 42 to the applicator surface 46 and the passage of air from outside through the slits into the reservoir. In the embodiment shown, cap 60E has an interior beveled side wall 71 which compresses the foam of the foam applicator head laterally as described above with respect to the applicator head of FIG. 15.

Figure 22:
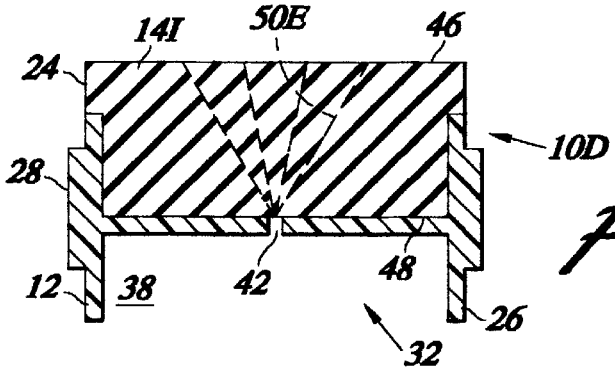
FIG. 22 is a side cross-sectional view of another embodiment of the foam applicator head of the present invention.

FIG. 22 shows an alternative embodiment of the applicator head of the present invention. Shell 12 of the applicator head 10 is identical to the shell shown in FIG. 6. The foam applicator head 141 has four parallel slits 50E. The slits angle downwardly from the applicator surface 46 to the base surface 48 to terminate at the base surface 48 over the opening 42. The slits 50 shown in the above applicator head have been perpendicular to the transverse wall. This applicator head can be closed with caps 60 through 60D described above.

With reference to FIGS. 27–19, 32 and 33, FIG. 27 shows another alternative embodiment of the applicator head of the present invention. The applicator head 10C is illustrated fitted with cap 60F. The applicator head has a modified nozzle 76A; the top of nozzle 76A has a chisel wedge shape as illustrated in FIG. 28. The opening 42 in the transverse wall 20 of the shell 12B of the applicator head 10C extends into a narrow opening 42B which opens to the head of the nozzle 76A. The narrow opening 42B is adapted to receive shaft 72 extending down from the inner side of the top wall of cap 60H (See FIG. 33) to seal off opening 42B. At the base of the shaft 72, four triangular fins 84 are positioned which are oriented vertically in the same direction as the slits 50 in the foam applicator head 14 (see FIGS. 29 and 32). When the cap 60H is positioned on the applicator head, the fins 78 enter into the slits 50 and compress against the walls of the slits 50 to help seal the slits to prevent leakage of preparation from the reservoir up through opening 42 and 42B and the slits 50, as described above with respect to other applicator heads. The nozzle 76A transversely compresses the foam applicator pad 14. It has been found that when the foam applicator head or pad 14 is inserted into the application chamber 36 of the shell (see FIGS. 29A, 35 and 27), the foam is compressed transversely against the shell 12B by the nozzle 76A which keeps the foam applicator pad 14 in the application chamber 36 without the need for adhesives or the like. However, adhesives or thermal bonding can be used to secure the foam pad 14.

Referring to FIGS. 30 and 31, another embodiment of the applicator head of the present invention is disclosed. The applicator head 10D is fitted with the cap 60F. The difference between applicator head 10C and 10D is nozzles 76A and 76B. The top portion of nozzle 76B has an inverted wedge shape, i.e., the top of the nozzle is a V-shape valley; the exact opposite shape of the chisel wedge shape of the top of nozzle 76A. Nozzle 76B also transversely compresses the foam applicator head 14 when it is placed in application chamber 36 of shell 12C. This transverse compression of the foam pad 14 maintains the pad in the applicator head 10D without the need for adhesives and the like as described above. However, adhesives or thermal bonding can be used to secure the foam pad 14.

Figure 34:
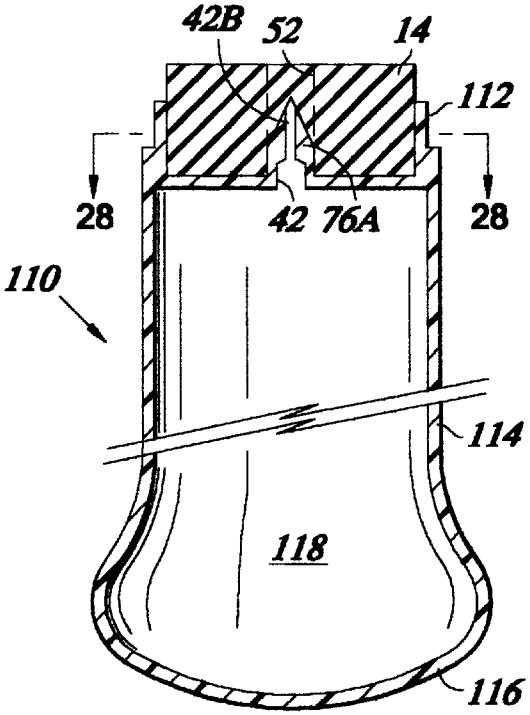
FIG. 34 is a side cross-sectional view of the combination of the improved applicator head of FIG. 27 integrally formed with a reservoir.

FIG. 34 illustrates another embodiment of the present invention where the applicator head and the reservoir are formed in one piece. The applicator head portion 112 is virtually identical to applicator head 10C illustrated in FIG. 27 and the same numbers are used to identify the same elements. In the embodiment shown, the reservoir portion 114 is a polymeric flexible tubing which has been heat- or cement-sealed at its far end to form sealed end 116. The reservoir chamber 118 receives the preparation of choice.

Figure 35:
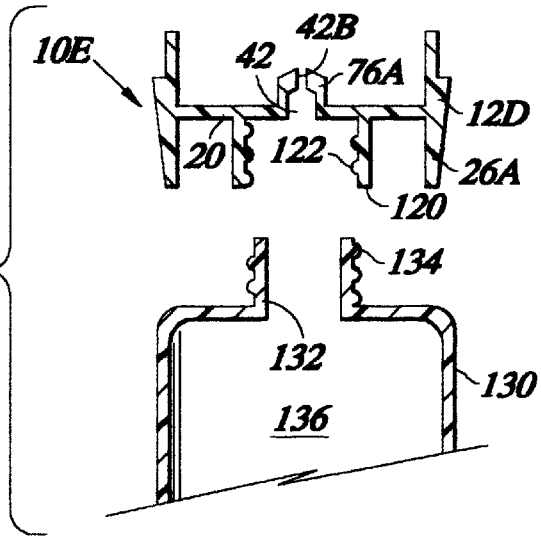
FIG. 35 is a side cross-sectional view of another embodiment of the improved applicator head used in conjunction with a screw top reservoir.
Figure 38:
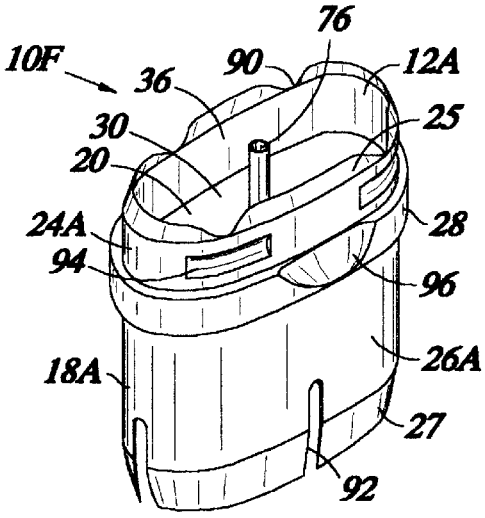
FIG. 38 is a top perspective view of another embodiment of the improved applicator head of the present invention.
Figure 39:
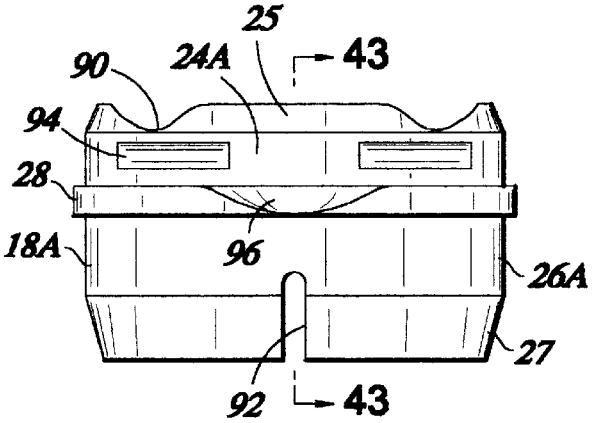
FIG. 39 is a front plan view of the improved applicator head of FIG. 38.
Figure 40:
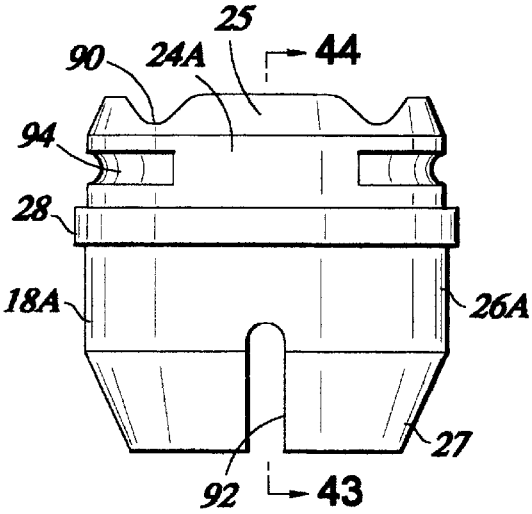
FIG. 40 is a side plan view of the improved applicator head of FIG. 38.
Figure 41:
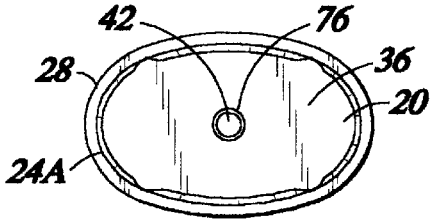
FIG. 41 is a top view of the improved applicator head of FIG. 38.
Figure 42:
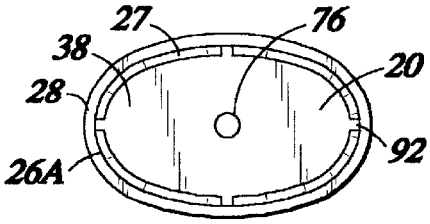
FIG. 42 is a bottom view of the improved applicator head of FIG. 38.
Figure 43:
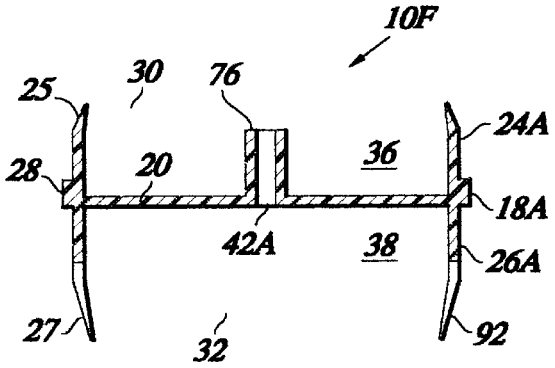
FIG. 43 is a cross-sectional view taken along lines 43—43 of FIG. 39.

FIG. 35 illustrates another embodiment of the applicator head of the present invention. Many preparations are supplied in screw top bottles (or tubes, containers, reservoirs, etc.) 130 having a screw top 132 with exterior male threads 134. The applicator head 12D is very similar to applicator head 10C illustrated in FIG. 27, and the same numbers are used to depict the same elements. Applicator head 12D is shown without a foam applicator head 14. In use, applicator head 12D would be filled with a foam applicator pad 14 in the same manner as applicator head 10C in FIG. 27. Applicator head 12D forms the cap to bottle 130. Applicator head 12D is adapted to be screwed on to a conventional bottle, glass or plastic, container having a male threaded top. Extending from the transverse wall 20 of the applicator head is female receptacle 120 having female threads 122 adapted to receive the male threaded top 132 similar to a bottle cap. The head has a lower fender 26A to cosmetically blend the head to the bottle.

The reservoirs or screw top bottles 130 come in all sizes, shapes, and are made of a variety of materials, including glass, plastic, and metal. Bottles or containers are supplied by a variety of manufacturers including Peerless, Nordon and other well-known manufacturers. The reservoirs 130 can have one of the standard neck styles such as Peerless #12, #16, #20, #28, M5, M8, 22/400, 28/410, DT, ET, Lube and the like. The cap style female receptacle 120 of the applicator head 12D is sized for a particular neck style of the reservoir 130. For example, neck 16 would receive a receptacle 120 similar to the receptacle size of standard cap 4465 or a receptacle 120 similar to the receptacle having similar size to Peerless cap 16-7 or 16-8. An M5 neck style would receive a receptacle having a size similar to the receptacle size of Peerless cap 4048 or 385. Neck style M8 would receive a female receptacle sized similar to the receptacle size of Peerless cap MJ431, MJ547, MJ267, MJ476, or 385. A reservoir having a neck style 22/400 would receive a receptacle sized as Peerless cap MJ539, MJ540, Polytop, or B22/2471.

Figure 36:
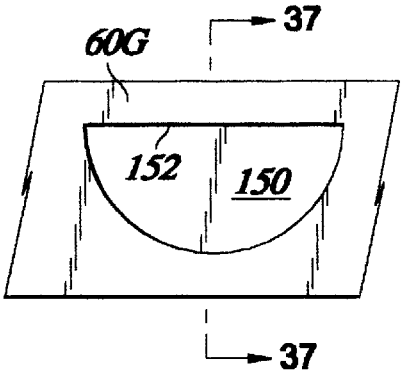
FIG. 36 is a fragmentary enlarged side cross-sectional view of an alternative embodiment of the cap FIG. 33.
Figure 37:
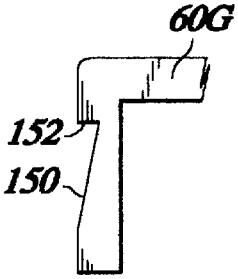
FIG. 37 is a cross-sectional view taken along lines 37—37 of FIG. 36.

FIG. 36 is a partial end view of the cap 60F' which is identical to cap 60F described above which the exception that half-moons 150 have been embossed at opposite ends of the cap to assist the user in removing the cap. The profile of the half-moons 150 are shown in FIG. 37. The top end of each half moon has a ledge 152 which a user's finger can engage to assist in removing the cap from the applicator head. The half moon profile can also reflect through (not shown) the side wall 74 of the cap to the interior of the cap to make the mating of the cap and applicator head more snug in order to more securely fasten the cap to the applicator head.

The invention has been illustrated with a head and cap having an oval or round configuration when viewed from the top and bottom. The configuration of the applicator head and cap from a top view can be round, square, rectangular, ellipsoidal or the like. The oval shape has been illustrated in most of the figures with top views because that is the shape which is intended to be manufactured. However, for lip balm, a round shape (top view) would probably be used. The flexible tube 100 of the reservoir is attached to the lower wall portion 26 of the shell 12 with adhesives or by heat treatment known in the art. The cap and the head are preferably detachably secured to one another with small embosses or ring indentations about upper wall 24 (not shown) on the inner wall of the cap and corresponding indentations (not shown) in the outer wall of the upper wall portion 24 of the shell or vice versa. Optionally, in the embodiment illustrated in FIGS. 20, 21, and 23, the shaft can have embossed areas or rings at its tip portion which engage indentations or ring grooves (not shown) in the opening 42 of the nozzle 76 or vice versa to help secure the cap to the applicator head.

Figure 24:
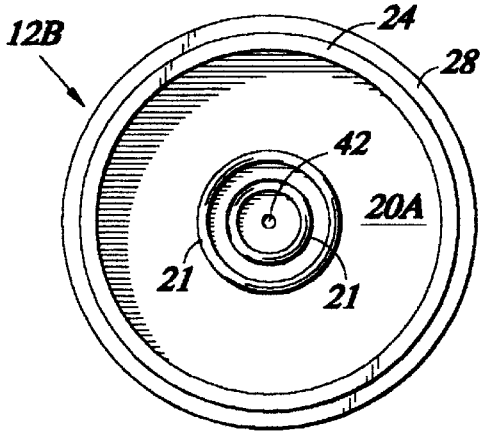
FIG. 24 is a top view of the shell of another embodiment of the improved applicator head of the present invention.
Figure 26:
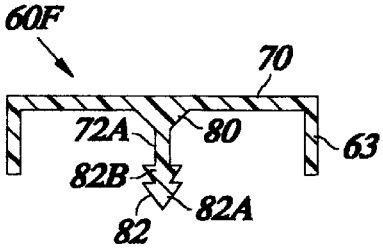
FIG. 26 is a side cross-sectional view of another embodiment of the improved cap for the improved applicator head of the present invention.
Figure 25:
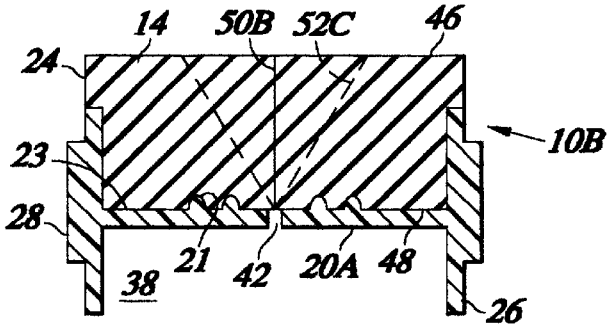
FIG. 25 is a side cross-sectional view of another embodiment of the improved applicator head of the present invention.
Figure 33:
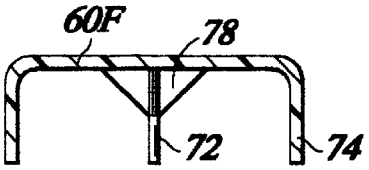
FIG. 33 is a side cross-sectional view of the cap of FIGS. 27 and 30.

Referring to FIGS. 24 through 26, in this embodiment of the improved applicator head, the shell 12B has a series of annular beads or ridges 21 which together with the base surface 48 of the foam applicator head 14 form a labyrinth seal. The labyrinth seal prevents or at least minimizes the profusion of preparation from the reservoir chamber 38 through the opening 42 between the base surface 48 and the top surface 23 of the transverse wall 28. This embodiment and the embodiment shown in FIGS. 27–32 can be used when there is concern that the preparation material will attack or weaken the adhesive cement or two-sided adhesive film that secures the base surface 48 of the foam applicator head to the top surface 23 of the transverse wall 20A. In order to further prevent migration of preparation along the base surface, the longitudinal length of the slit 50B decreases progressively from the applicator surface 46 to the base surface 48, as shown by limit lines 52C, to the width of opening 42.

Referring to FIG. 26, cap 60G can be employed for the improved applicator head 10B. Cap 60G has a central shaft extending downwardly from the inner surface of the top transverse wall 70. The base 80 of the shaft 72A has a conical cross-section. The walls of the base 80 cap is seated on the improved applicator head apply a radial compressive force to the applicator portion of the foam applicator head to compress the walls of the slits together to further seal the slits. In addition, the bottom tip of the shaft 72A has a conical cross-section. In this particular embodiment, the shaft has two conical sections 82A and 82B. When these conical sections are inserted into the foam applicator head, they compress the foam radially outwardly to help further seal the slits by compressing the foam. Cap 60G is not limited to the improved applicator head 10B. It can also be used for the applicator head 10A, 10B, and 10C as described above with respect to FIGS. 1 through 6, 8, 9, and 21.

Figure 45:
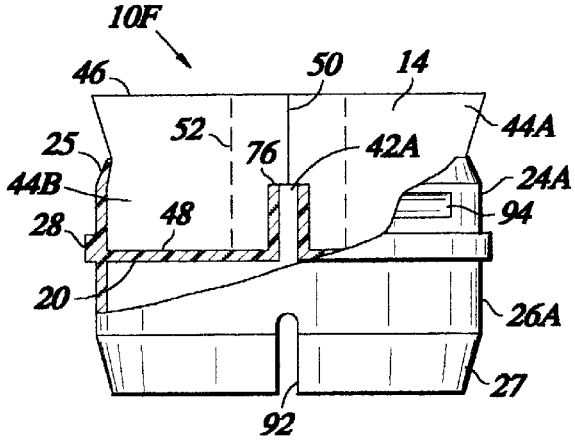
FIG. 45 is a fragmentary front cross-sectional view of the improved applicator head of FIG. 38.
Figure 44:
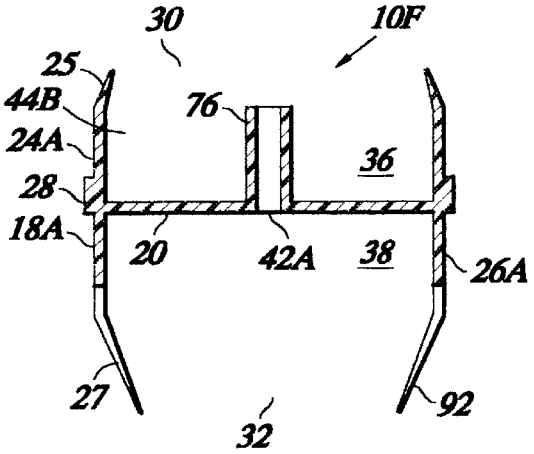
FIG. 44 is a cross-sectional view taken along lines 44—44 of FIG. 40.
Figure 46:
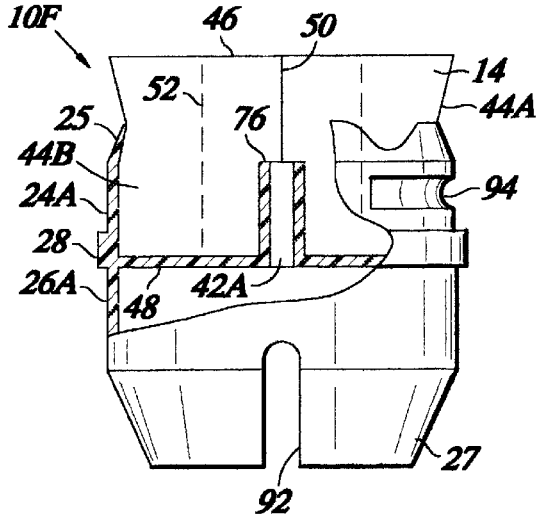
FIG. 46 is a fragmentary side cross-sectional view of the improved applicator head of FIG. 38.

Referring to FIGS. 38–47, the improved applicator head 10F comprises a shell 12A with a foam applicator head 14 (FIGS. 45 and 46). Shell 12A has a perimeter wall 18A and a transverse wall 20 inside the shell extending from the inner side of the perimeter wall completely across the shell. The perimeter wall has an upper wall portion 24A and a lower wall portion 26A and a shoulder 28. A flexible polymeric tubular reservoir (not shown) can be sealed to the outer side of the lower wall portion as described above with respect to the improved applicator head 10. The upper wall portion 24A is adapted to receive a cap, such as cap 60E and 60F described above, to seal off the applicator head. The shell 12A has an open applicator end 30 and an opposite open reservoir end 32. The transverse wall divides the inner space of the shell into an application chamber 36 and a reservoir chamber 38 (see FIGS. 38, 43 and 44). The transverse wall has an opening 42A in fluid communication with the reservoir chamber. A hollow nozzle 76 extends upward from the transverse wall 20 into the application chamber 36. Opening 42A extends from the reservoir chamber 38 through the transverse wall up through the nozzle 76 into the application chamber 36.

The foam applicator head or pad 14 is positioned within the application chamber 36 (see FIGS. 45 and 46). The upper or applicator portion 44A of the foam applicator head extends beyond the open applicator end 30 of the shell. The foam applicator head has an application surface 46 and a base surface 48. The lower or base portions 44B of the foam applicator head 14 is located in the application chamber 36. The foam applicator head 14 is retained in the application chamber 36 by the upper lips 25 on the upper wall portion 24A. The upper lips 25 bevel inwardly from the outer perimeter of the upper wall portion, thus removably securing or locking the foam applicator head into the application chamber. Because of the construction of the upper wall portion 24A with the upper lips 25 beveled inwardly and separated by relief cutouts 90, the beveled inwardly upper lips can be bowed out for removal or insertion of the foam applicator head into the application chamber.

If required, the foam applicator head can be pulled out of the application chamber to be cleaned off, or disposed of and replaced with a new foam applicator head. Thus, if a person using the improved applicator head with a reservoir dropped the foam applicator head and got it dirty with dirt, sand, or the like, or the foam applicator head otherwise became dirty, the foam applicator head can be removed or cleaned and replaced.

The foam applicator head has two longitudinal slits 50 cut through the foam applicator head in the form of a cross from the top view (see FIGS. 4 and 5). As described above, the slits are cut, not grooved, through the foam. When the foam is in a resting state, the slits are not channels and material from the reservoir cannot pass through the opening 42A into and through the slits to the top surface 46 of the foam applicator head. The walls of the slits are closed together in their normal state. The foam, because of its compressible properties, keeps the walls of the slits 50 together preventing the medicinal, pharmaceutical, therapeutic, or cosmetic preparation in the reservoir chamber from seeping up through opening 42A and slits 50. Similarly, the compressive force of the foam keeps the walls of each slit together to prevent air from diffusing from the exterior into the reservoir chamber 38 through the slits and through the opening.

Figure 47:
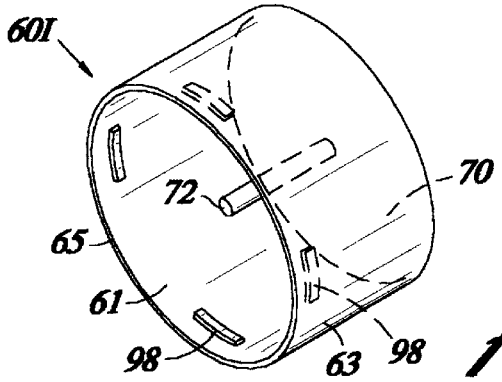
FIG. 47 is a bottom perspective view of a cap for the improved applicator head of FIG. 38.

The applicator head 10F is capped off with a cap 60I having a shaft as shown in FIG. 47, which is similar to caps 60E, 60F, 60G, and 60H of FIGS. 20, 27, 30, and 33. When the cap is placed on the applicator head 10F, the shaft 72 penetrates the foam applicator head through the slits 50 into the opening 42A of the nozzle 76. The mating of shaft 72 within nozzle 76 secures the cap to the applicator head and functions as valve means for minimizing the passage of preparation from the reservoir chamber through the opening 42A and the slits 50 onto the applicator surface 46 when the cap is seated on the applicator head. The mating of shaft 72 with the opening 42A also centers and guides the cap onto the applicator head 10F. The shaft 72 also helps to compress the foam of the foam applicator head which, in turn, forces the walls of the slits together to form a tighter seal between the wall and the slits to prevent the passage of preparation out of opening 42A through the applicator head slits to the applicator surface and the passage of air from the outside to the slits and to the reservoir chamber.

The upper wall portion 24A terminates with a plurality of inwardly beveled upper lips 25. The lips are separated by relief cutouts 90 which are required in order to manufacture the improved applicator head and in order to be able to bow out the inwardly beveled upper lips to insert and remove a foam applicator head. The lower wall portion 26A terminates with lower lips 27 which are beveled inwardly. The lower lips 27 are separated by release slots 92. The release slots are required in order to manufacture the improved applicator head with inwardly beveled lower lips and to permit the lower lips to be bowed out. The beveling inwardly of the terminating walls, i.e., the lower lips 27 on the lower wall portion 26A, makes it easier to insert the applicator head into a reservoir 100 which is described above. The lower wall portion 26A goes inside a flexible reservoir, such as reservoir 100 of FIG. 23, and the inner walls of the flexible reservoir are sealed to the outer walls of the lower wall portion.

When three-dimensional objects are injection-molded, the mold is generally of two parts and must be able to come apart and the molded part must be capable of being withdrawn from the mold. When a molded object has a beveled inward portion, such as the improved applicator head 10F, there must be means of permitting the beveled inwardly portions, namely upper lips 25 and lower lips 27 to be removed from the mold. This can be accomplished by permitting the upper lips 25 and the lower lips 27 to bow out to remove the parts from the mold. By not making the beveled inward upper lip continuous around the periphery, but divided into a plurality of upper lips 25 by relief cutouts 90 which extend the full depth of the upper lips to the top of the upper wall portion 24A, the lips can be bowed out. Similarly, in order to bow out the lower lips 27, which may have a plurality of lower lips rather than a continuous lower lip extending the full periphery of the lower wall portion, the lower lips are separated by release slots 92 which permit the lower lips to be bowed out and thus removed from the mold. A continuous upper lip and lower lip could not be bowed out any more than upper wall portion 24A or lower wall portion 26A. It is preferred to have the lower wall portion terminate with the inwardly beveled lower lips. However, it is not required and the lower wall portions illustrated for the other improved applicator heads described above can be employed, such as the lower wall portion 26 illustrated in FIGS. 1 through 7. It is preferred to have the upper wall portion terminate with a plurality of beveled inwardly upper lips in order to retain the foam applicator head 14 without the need to use the adhesives, two-side adhesive tapes, and the like. The inwardly beveled upper lips permit the foam applicator head to be relatively easily inserted into the application chamber 36 of the improved applicator head and to be removable when desired, either to remove the foam applicator head, clean the foam applicator head, or replace the foam applicator head with a new foam applicator head.

The upper wall portion 24A is fitted with slots 94 around the periphery of the upper wall portion which dovetail and are in registry with bossed tabs 98 in the inner wall 61 of the cap 60I to lock the cap onto the applicator head 10F. In order to aid in removing cap 10F from the applicator head, the shoulder 28 has a relief slot 96 which extends almost to the outer periphery of the upper wall portion 24A to permit a person to insert his/her fingers underneath the edge 65 of the perimeter wall 63 of the cap, which has an outer periphery contiguous with the outer periphery of the shoulder 28 to aid in pulling the cap 60I off the applicator head 10F.

The applicator head can be used for a variety of liquid, gel, semi-solid preparations and compositions, including medicinal, pharmaceutical, therapeutic, and cosmetic preparations such as skin creams, dermal compositions, lip balm, muscle ointments, external analegisics, sunscreen compositions, insect repellents, moisturizing compositions, skin shading or coloring compositions and the like.

The foam applicator head 14 can be prepared from a variety of foam materials. For applicator heads intended for the application of preparations and compositions to humans and animals, the foam will be a medicinal and cosmetically acceptable foam. When the foam applicator is used for applying materials to other surfaces, the foam merely has to be compatible with the preparation or composition. Preferably, the foam is a closed cell foam so that it does not become saturated with the composition or preparation. Preferably, the composition or preparation will only sit on the applicator surface 46 and will not penetrate into the foam. A polyethylene foam having a smooth sealed outer surface has been found to be suitable.

The present invention has been illustrated with specific examples. However, the invention is not limited to the specific embodiments shown. The concept of the invention is to seal off the reservoir from the applicator surface by employing a slit valve means in the foam applicator head which, when compressed by the closure of the cap and/or the insertion of a shaft, compresses the walls of a slit together to form a seal which prevents the passage of preparation from the reservoir and air into the reservoir.

I claim:

1. An improved applicator head comprising a hollow applicator head shell having a central cavity, a perimeter wall surrounding the central cavity, an open applicator end at its top and an opposite reservoir end communicating with the central cavity, and a transverse wall within the shell separating the central cavity into an applicator chamber opening into the open application end, and a reservoir chamber opening into the open reservoir end, the transverse wall having at least one opening between the applicator chamber and the reservoir chamber; the perimeter wall surrounding the applicator chamber having a plurality of inwardly beveled lips extending upwardly from the perimeter wall, the lips separated from one another;

a foam applicator head having an applicator surface and an opposite face surface, the foam applicator head positioned in the applicator chamber with the applicator surface extending beyond the open applicator end, the lips removably securing the foam applicator head into the applicator chamber, the applicator head having at least one slit extending from the applicator surface through the foam to the base surface, at least a portion of each slit at the base surface positioned on one of said openings in the transverse wall; the walls of each slit normally compressed together to seal each slit.

2. The improved applicator head according to claim 1 wherein the foam applicator head has one slit.

3. The improved applicator head according to claim 1 wherein the foam applicator head has two slits.

4. The improved applicator head of claim 3 wherein the foam applicator head has two slits crossing each other at their central regions to form a cross configuration in a top view.

5. The improved applicator head of claim 1 wherein the foam applicator head has three or more slits.

6. The improved applicator head according to claim 1 wherein the length of the slits from the applicator surface through the foam to the base surface remains constant.

7. The improved applicator head according to claim 1 wherein the longitudinal length of the slits from the applicator surface through the foam to the base surface decreases.

8. The improved applicator head according to claim 1 wherein the transverse wall has one opening.

9. The improved applicator head according to claim 8 wherein the transverse wall includes a hollow shaft extending upwardly from the transverse wall towards the applicator surface, the elevation of the hollow shaft not extending to the applicator surface, the hollow shaft constituting the opening of the transverse wall.

10. The improved applicator head of claim 9 wherein the foam applicator head has two slits intersecting each other to form a cross in a top view, the center of the cross positioned over the hollow shaft.

11. The improved applicator head according to claim 1 wherein each slit is positioned at the base surface over two or more openings.

12. The improved applicator head of claim 1 wherein the hollow applicator head shell has an elliptical shape in a top view with a long axis and short axis.

13. The improved applicator head of claim 12 wherein the hollow applicator head has four inwardly bevel lips.

14. The improved applicator head of claim 13 wherein two of the lips are positioned on the long axis and the other two lips are positioned on the short axis.

15. An improved applicator head comprising a hollow applicator head shell having a central cavity, a perimeter wall surrounding the central cavity, an open applicator end at its top and an opposite reservoir end communicating with the central cavity, and a transverse wall within the shell separating the central cavity into an applicator chamber opening into the open application end, and a reservoir chamber opening into the open reservoir end, the transverse wall having at least one opening between the applicator chamber and the reservoir chamber; the perimeter wall surrounding the applicator chamber having a plurality of inwardly beveled lips extending upwardly from the perimeter wall, the lips separated from one another;

a foam applicator head having an applicator surface, an opposite base surface, an application portion, and a base portion, the base portion of the foam applicator head positioned in the applicator chamber with the applicator portion extending beyond the open applicator end, the inwardly beveled lips removably securing the foam applicator head into the applicator chamber, the applicator head having at least one slit extending from the applicator surface through the foam to the base surface, at least a portion of each slit at the base surface positioned over one of said openings in the transverse wall; the walls of each slit normally compressed together to seal each slit; and an applicator head cap having a perimeter wall, a top transverse wall, a closed top end and an open bottom end, the top transverse wall sealing off the top end of the cap with the perimeter wall, the open bottom end of the cap adapted to receive and seat on the application end of the improved applicator head.

16. The improved applicator head according to claim 15 wherein the inner side of the perimeter wall of the cap is beveled inwardly towards the top transverse wall and adapted to laterally compress the applicator portion of the foam applicator head when the cap is seated on the improved applicator head.

17. The improved applicator head according to claim 15 wherein the inner side of the top transverse wall of the cap has a step platform extending towards the open bottom end of the cap adapted to compress the applicator surface of the foam applicator head longitudinally downward to compress the applicator surface and a portion of the applicator portion of the foam applicator head when the cap is seated on said head.

18. The improved applicator head according to claim 15 wherein the inner side of the top transverse wall of the cap has at least one annular bead extending downwardly from the interior side towards the open end of the cap and which is adapted to compress the applicator surface of the foam applicator head and a portion of the applicator portion of said head with an annular compression zone to prevent migration of air and preparation between the inner side of the cap and the applicator surface of the foam applicator head when the cap is seated on said head.

19. The improved applicator head of claim 15 wherein the inner side of the top transverse wall of the cap has a dome portion extending downwardly towards the open end of the cap and which is adapted to compress the applicator surface and at least a portion of the applicator portion of the foam applicator head to compress the walls of the slits together when the cap is seated on said head.

20. The improved applicator head according to claim 15 wherein the applicator head has a hollow shaft extending upwardly from the transverse wall towards the applicator surface, the elevation of the hollow shaft not extending to the applicator surface, the hollow shaft constituting the opening in the transverse wall, and the cap has a shaft extending downwardly from the inner side of the top transverse wall, the shaft of the cap adapted to enter the hollow shaft when the cap is seated on the applicator head to seal off the opening.

21. The improved applicator head according to claim 20 wherein the foam applicator head has two slits intersecting each other to form a cross in a top view, the center of the cross positioned over the hollow shaft.

22. The improved applicator head of claim 15 wherein the hollow applicator head shell has an elliptical shape in a top view with a long axis and a short axis.

23. The improved applicator head of claim 15 wherein the hollow applicator head has four inwardly beveled lips.

24. The improved applicator head of claim 23 wherein two of the lips are positioned on the long axis and the other two lips are positioned on the short axis.

25. An improved applicator for medicinal, pharmaceutical, therapeutic and cosmetic preparations comprising a hollow applicator head with a shell having a central cavity, a perimeter wall surrounding the central cavity, an open applicator end at its top, and an opposite open reservoir end and a transverse wall within the shell separating the central cavity into an applicator chamber communicating with the open applicator end and the reservoir chamber communicating with the open reservoir end, said transverse wall having at least one opening between the applicator chamber and the reservoir chamber; the perimeter wall surrounding the applicator chamber having a plurality of inwardly beveled lips extending upwardly from the perimeter wall, the lips separated from one another;

a foam applicator head having an applicator surface and an opposite base surface, an applicator portion and a base portion, the base portion of the foam applicator head positioned in the applicator chamber with the applicator portion extending beyond the open applicator end, the inwardly beveled lips removably securing the foam applicator head into the applicator chamber, the applicator head having at least one slit extending from the applicator surface through the foam to the base surface, at least a portion of each slit in the base surface positioned over one of said openings in the transverse wall; the walls of each slit normally compressed together to seal each slit;

an applicator head cap having a perimeter wall, a top transverse wall, a closed top end and an open bottom end, the top transverse wall together with the outer perimeter wall sealing off the top end of the cap, the open bottom end of the cap adapted to receive and seat on the application end of the shell of the improved applicator head; and a flexible tubular reservoir member for holding medicinal, pharmaceutical, therapeutic, and/or cosmetic preparations and compositions, the remote end of the tubular member being sealed off, the near end of the tubular member adapted to receive the open reservoir end of the applicator head and to be secured thereto in a sealed relationship.

26. The improved applicator head according to claim 25 wherein the foam applicator head has two slits transversely crossing each other at a 90° angle in their central region to form a cross from a top view.

27. The improved applicator according to claim 26 wherein the transverse wall has one opening, and the center of the cross is positioned over the opening.

28. The improved applicator according to claim 25 wherein the inner side of the perimeter wall of the cap has means to laterally compress the applicator portion of the foam applicator head when the cap is seated on the applicator head to seal the walls of the slits together.

29. The improved applicator head according to claim 25 wherein the applicator head has a hollow shaft extending upwardly from the transverse wall towards the open applicator end of the shell, the hollow shaft constituting the opening in the transverse wall, the cap having a shaft extending downwardly from the inner side of the top transverse wall, the shaft of the cap adapted to enter the hollow shaft in a male-female relationship when the cap is seated on the applicator head to seal off the opening.

30. The improved applicator head according to claim 29 wherein the foam applicator head has two slits intersecting each other to form a cross in a top view, the center of the cross positioned over the hollow shaft.

31. The improved applicator head of claim 25 wherein the hollow applicator head shell has an elliptical shape in a top view with a long axis and short axis.

32. The improved applicator head of claim 31 wherein the hollow applicator head has four inwardly bevel lips.

33. The improved applicator head of claim 31 wherein two of the lips are positioned on the long axis and the other two lips are positioned on the short axis.

* * * * *